US006199829B1

(12) United States Patent
Brown et al.

(10) Patent No.: US 6,199,829 B1
(45) Date of Patent: Mar. 13, 2001

(54) WIRE TRACTOR

(76) Inventors: Jim R. Brown, 409 W. Randolph St., Lansing, MI (US) 48906; Elwin C. Munson, P.O. Box 2319, Candler, NC (US) 28715; Douglas N. Adams, 190 Johnson Blvd., Asheville, NC (US) 28806; Leslie D. Van Way, P.O. Box 327, Corning, OH (US) 43730

( * ) Notice: Subject to any disclaimer, the term of this patent is extended or adjusted under 35 U.S.C. 154(b) by 0 days.

(21) Appl. No.: 09/580,477

(22) Filed: May 26, 2000

Related U.S. Application Data

(60) Provisional application No. 60/137,278, filed on Jun. 3, 1999.

(51) Int. Cl.[7] ..... B65H 59/00

(52) U.S. Cl. ..... 254/134.5; 254/134.5; 254/134.3 R; 104/112

(58) Field of Search ..... 254/134.5, 134.3 R, 254/134.3 PA, 134.3 FT; 104/112, 114, 117.1, 138.2; 191/12 R; 105/148, 150

(56) References Cited

U.S. PATENT DOCUMENTS

| | | | | |
|---|---|---|---|---|
| 628,994 | | 7/1899 | Schottle et al. . | |
| 683,515 | * | 10/1901 | Stewart | 254/134.5 |
| 695,504 | | 3/1902 | Stewart . | |
| 798,602 | * | 9/1905 | Detchon | 254/134.5 |
| 1,976,990 | * | 10/1934 | Guthrie | 254/134.5 |
| 2,228,034 | | 1/1941 | Nelles . | |
| 2,604,521 | * | 7/1952 | Boucher | 254/134.5 |
| 3,448,694 | | 6/1969 | Seyfried . | |
| 3,498,236 | | 3/1970 | Meek . | |
| 3,672,636 | * | 6/1972 | Parsen | 254/134.3 R |
| 3,861,650 | * | 1/1975 | Jackson | 254/134.3 R |
| 4,014,516 | * | 3/1977 | Jacks | 254/134.3 R |
| 4,386,759 | * | 6/1983 | Grover | 254/134.5 |
| 5,020,443 | | 6/1991 | Gauthier . | |
| 5,103,738 | | 4/1992 | Claussen . | |
| 5,120,911 | | 6/1992 | Gazzola . | |
| 5,683,073 | * | 11/1997 | Pickrell | 254/134.3 FT |
| 5,901,651 | * | 5/1999 | Boyd | 254/134.5 |

* cited by examiner

*Primary Examiner*—David A. Scherbel
*Assistant Examiner*—Daniel Shanley
(74) *Attorney, Agent, or Firm*—John G. Premo

(57) ABSTRACT

The invention, in a preferred embodiment, is an apparatus for pulling wire and other objects between two vertical supports, such as telephone poles, connected by a cable strung above the ground. It is particularly suited for making lashers easier to use in rough terrain. The device consists of a carrier having four sides, a base, and an adjustable split top having an upper surface and a lower surface. Contained in and on the carrier is a pair of gear driven looped roller chains horizontally mounted on opposite sides of the split top. These roller chains have mounted about their outside surfaces cable-gripping clips. A pressure-regulating bar is positioned within the inside vertical surfaces of the opposed looped roller chains. Also present is a drive for adjusting the split top so that the opposed looped roller chains engage the strung cable. Within the carrier is mounted a motorized drive train for turning the opposed looped roller chains in opposite directions at a constant speed. To propel the carrier, there is a pair of vertical trolley wheels positioned above the opposed looped roller chains for moving the carrier along the string cable. A single motor drives the two looped roller chains by means of gear-connected shafts. In a preferred embodiment, the motor is a battery-driven DC motor.

18 Claims, 3 Drawing Sheets

WIRE TRACTOR

CLAIM FOR PRIORITY

This is a non-provisional application, filed claiming the priority of a provisional application filed on Jun. 3, 1999, with Ser. No. 60-137,278.

FIELD OF THE INVENTION

The invention relates to a motorized device for stringing wire.

BACKGROUND OF THE INVENTION

The invention relates to a motorized wire tractor for stringing wire and cable, as well as pulling lashers and the like, in addition moving other objects which utilize a cable strung above ground.

DESCRIPTION OF THE PRIOR ART

It is common practice to anchor phone lines, power lines, and cables from stranded support cables strung above the ground between power poles. In the case of phone lines and optical cables, where there a number of such lines suspended or to be suspended from a support cable, it is a common practice to bind these bundles of wires together using a device known as a lasher. These hand-pulled devices ride on the support wire. The lasher contains a magazine consisting of a spool of wire. As the lasher is pulled along, it winds wire from the spool around the wire to be bundled and "lashes" one or more cables to the support cable. Illustrative of such lashers is the APOLLO LASHER sold by General Machine Products and described on its Web site at www.generaltools.com. The material contained in this Web site is incorporated by reference.

In high wire construction which is performed by phone, electric utilities, and cable companies, it is not uncommon to pull or string wire over difficult terrain, such as through thick trees, over bodies of water, between high hills and mountains, and other similar areas. When such difficult areas are encountered, the manual pulling of wires and cables or lashing operations are difficult and are time-consuming and require additional manpower. If it were possible to perform these operations using a motorized self-contained wire tractor or puller, it would be of tremendous value to the electrical transmission industries, telecommunications companies, and other similar entities that must install wires under such conditions.

While there have been attempts to provide mechanical devices to pull wire over adverse terrain, these devices have not been entirely successful or well received. It would be an advancement in the art if it were possible to have a device that would pull wire, lashers, and other wire-binding devices, as well as move loads of heavy equipment and other objects. Thus, while the invention is referred to as a "wire tractor" it is to be understood that it is particularly adapted to pull lashers, wire, cable, and move other objects over a cable strung between two above-ground points, hence the term "wire tractor" is intended to cover these other applications of the apparatus described hereafter.

SUMMARY OF THE INVENTION

The present invention is directed to an apparatus for pulling wire and other objects between two vertical supports connected by a cable strung above the ground. It is particularly suited to pulling lashers over rough terrain using a small crew and a self-propelled device to pull a lasher along the cable. The invention in its broadest aspects comprises a carrier having four sides, a base, and an adjustable split top having an upper surface and a lower surface. There are a pair of driven looped belts horizontally mounted on opposite sides of the split top, running parallel to the split top, having outside cable-gripping surfaces. The looped belts are preferably a pair of gear-driven looped roller chains. The invention will be described hereafter with respect to this preferred embodiment.

The looped roller chains have mounted about their outside surfaces cable-gripping clips. These clips are C-shaped and are sized to frictionally engage the cable. There is also a pressure-regulating bar positioned within the inside surfaces of the opposed looped roller chains. When optical cable is being lashed, it is beneficial if the looped roller chains are covered with a belted loop, having treads which act as clips for engaging the cable.

Within the carrier is a drive for adjusting the split top so that the opposed looped roller chains engage the strung cable. Further, there is a carrier-mounted motorized drive train for turning the opposed looped roller chains in opposite directions at a constant speed. Finally, in the broadest aspect of the invention, there is a pair of vertical trolley wheels positioned above the opposed looped roller chains for supporting the carrier along the strung cable.

Other features of the invention include the looped roller chains being driven by a single motor. The drive train is a gearbox that rotates two spur gear connected shafts that turn adjacent drive gears on either side of the split top in opposite directions. In one embodiment, one of the spur gear connected shafts is an adjustable shaft and only the non-drive gear of the split top is adjustable. The adjustable shaft in another preferred embodiment contains one, and preferably two, universal joints.

The drive for adjusting the split top is a rotatable horizontally mounted shaft on the carrier having a threaded end which engages a thread-receiving mounting, located on the bottom of the adjustable side of the split top. There is a U-shaped frame mounted to the rear of the bottom of the adjustable side of the split top, with the base of the "U" being connected to at least one, and preferably two, vertically mounted ball joints. The vertically mounted ball joints connected to the base of the "U" provide an arcuate path to the adjustable side of the split top when it is moving to engage the cable.

A single motor is a DC motor, which is mounted on the bottom of the carrier and is actuated with electronic controllers, which are either hard wired or radio controlled for reversing shaft rotation and providing an on and off function. The DC motor is desirably battery-powered. The battery is mounted in a housing attached to the earlier. The battery housing has a pair of cable-engaging top mounted vertical trolley wheels. In yet another desirable embodiment, the lower surface of the carrier contains an end-mounted eyelet.

BRIEF DESCRIPTION OF THE DRAWINGS

In the drawings, like parts have like numbers.

DETAILED DESCRIPTION OF THE INVENTION

Figure 1:
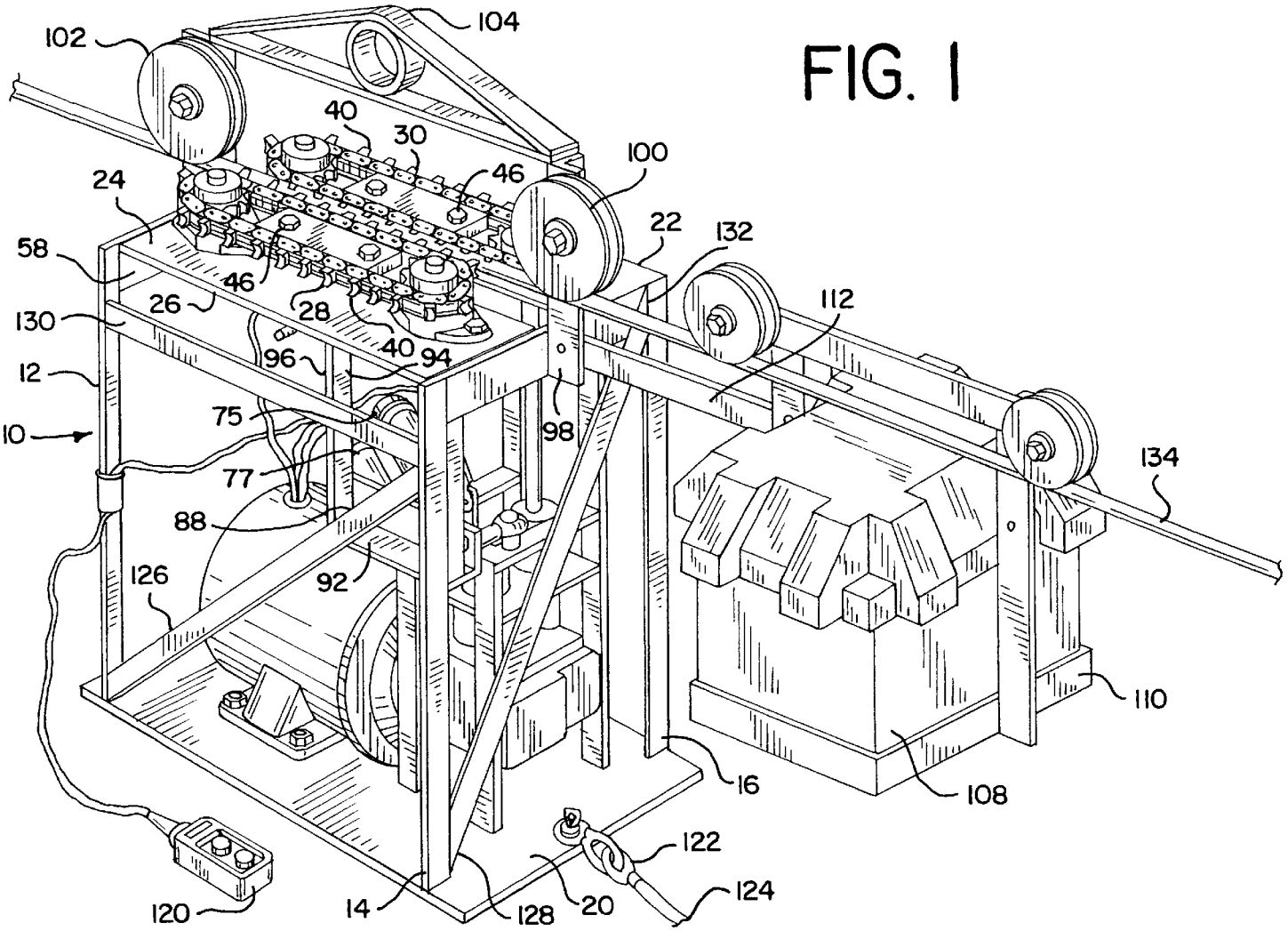
FIG. 1 is an elevational perspective view of the wire tractor of the invention.

The wire tractor apparatus of the invention, as shown in FIGS. 1–5, comprises a carrier 10, which is composed of four vertical supports designated by the numerals 12, 14, 16, and 18. Mounted upon the bottom of the supports is a base 20. Upon the top of the supports is a split top 22, which has an upper surface 24 and a lower surface 26, which is shown to best advantage in FIG. 2.

Figure 2:
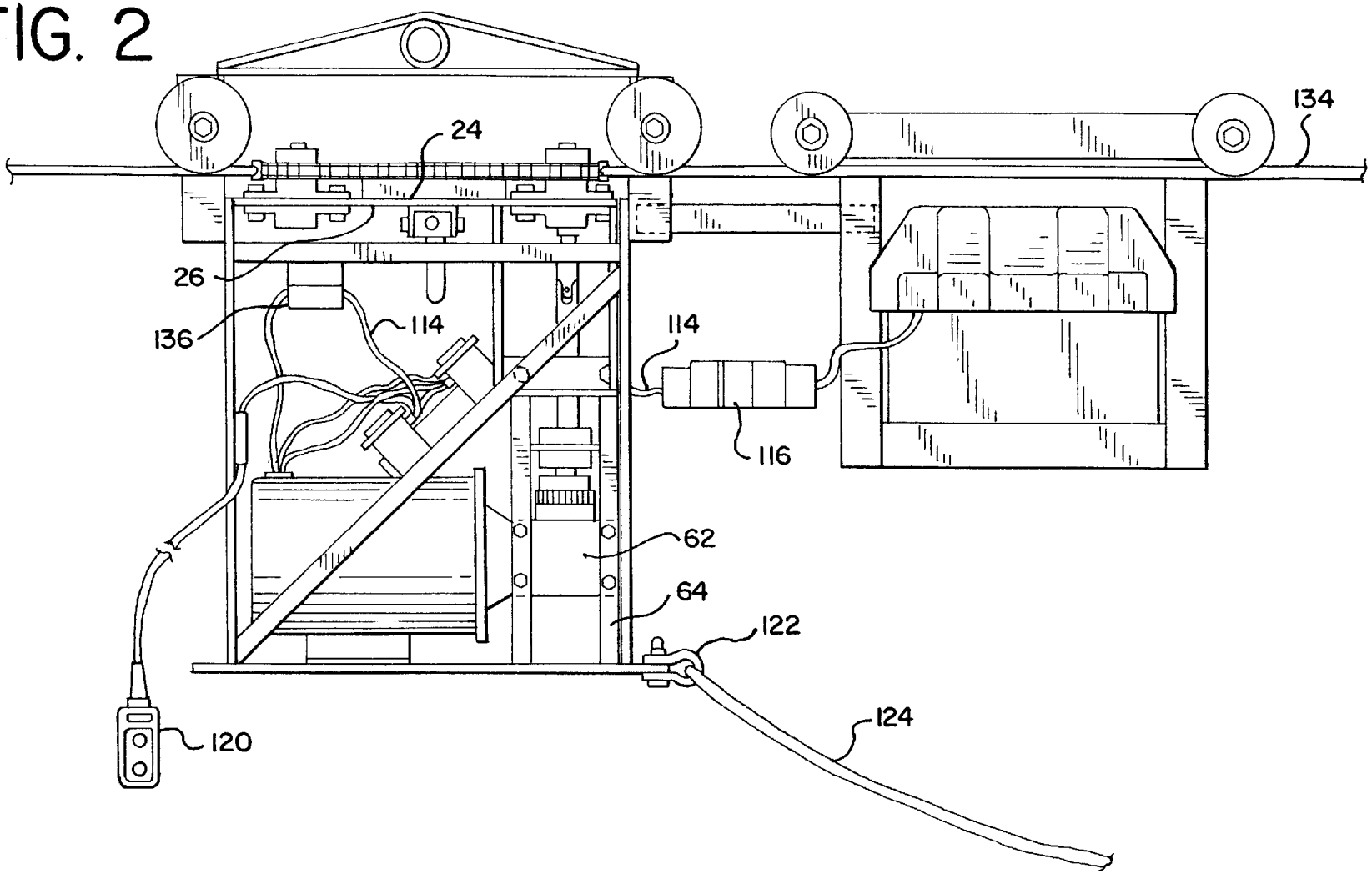
FIG. 2 is an elevational side view corresponding to FIG. 1.
Figure 3:
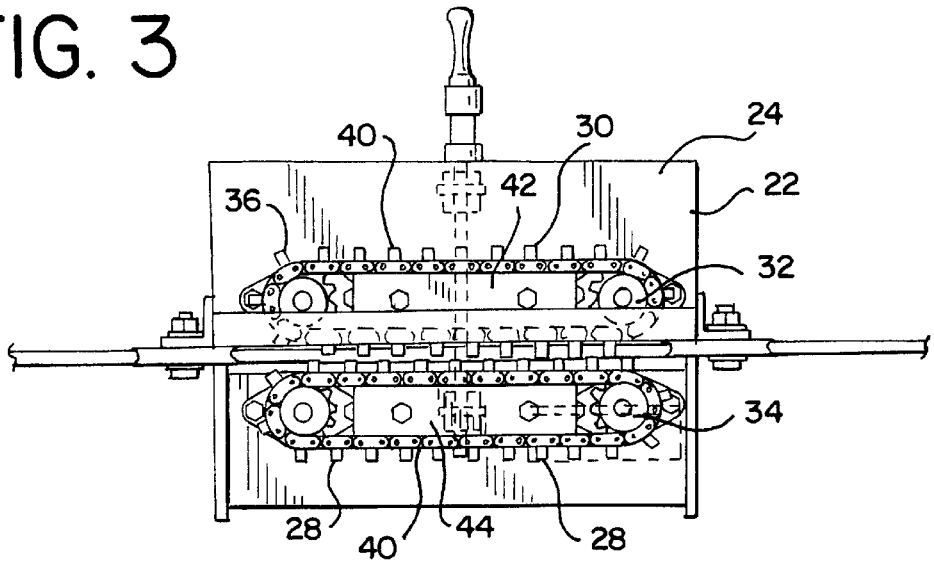
FIG. 3 is a top view of the wire tractor of the invention showing the drive mechanism.
Figure 6:
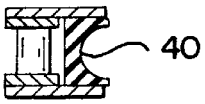
FIG. 6 is a cross sectional side view of a cable-gripping clip.

In FIGS. 1, 2, and 3, there are mounted on opposite sides of split top 22 a pair of looped roller chains 28 and 30. As can be seen from FIGS. 1 and 3, the looped roller chains 28 and 30 are horizontally mounted and engage drive gears 32 and 34 and sprocket gears 36 and 38. Located about the outside of looped roller chains 28 and 30 is a plurality of cable gripping clips 40. The detail of these cable-gripping clips 40 is shown in FIG. 6. The cable-gripping clips 40 may be attached to the looped roller chains 28 and 30 by means of welding, or they may be cast to include and become a part of individual links of the looped roller chains 28 and 30.

Positioned in the center of each looped roller chain are pressure-regulating bars 42 and 44, which are mounted to the split top 22 by means of bolts 46. These bars prevent inward flexing of the linked roller chains.

Figure 4:
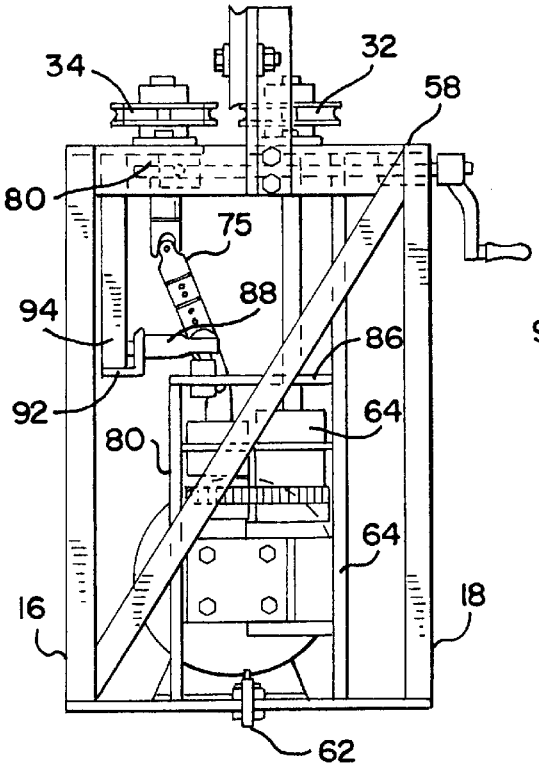
FIG. 4 is an elevational side view showing the wire tractor in the open non-cable-gripping position.

As shown in FIG. 4, the split top 22, which supports gears 32, 34, 36, and 38, has fitted on its bottom a female-threaded mounting 48. Threaded into the female-threaded mounting 48 is a rotatable horizontal shaft 50, which is most clearly shown in FIG. 5, having a threaded end 52, which engages female-threaded mounting 48. The opposite end of the rotatable horizontal shaft 50 contains a crank handle 54. To support the rotatable horizontal shaft 50, there is provided a bored mounting block 56, which is attached to a horizontal bars 58 attached to the top vertical supports. Horizontal bars 58 also provide support for split top 22.

Mounted on the base 20 of carrier 10 is DC motor 60, which, in a preferred embodiment, is reversible and is capable of being controlled to produce variable speeds. AC or gasoline powered motors may be substituted for the DC motor. The DC motor 60 is connected to gearbox 62, mounted within the carrier 10 by support frame 64. The gearbox 62 not only provides speed control, but converts the horizontal rotary motion of DC motor 60 into vertical rotational motion, which is captured by geared drive shaft 64, which passes through horizontal support plate 66 and through opening 68 in the split top 22. The end of the geared drive shaft 64 is fitted into drive gear 32. Although not shown, it is beneficial that bushings or bearings be used in horizontal support plate 66 and opening 68 in the split top 22 to allow for smooth operation of the gear 32.

Figure 5:
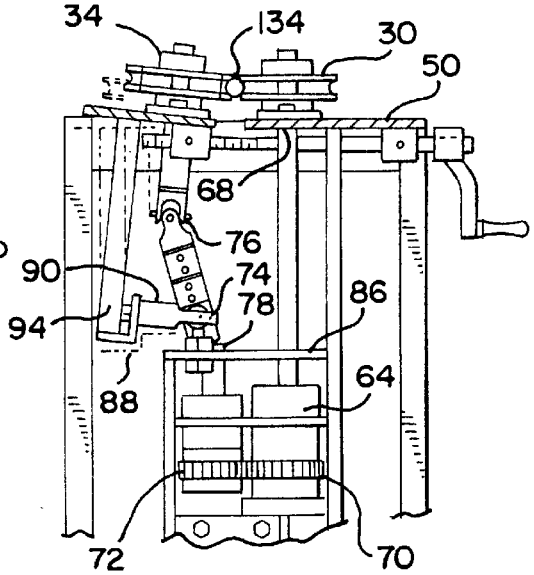
FIG. 5 is a partial elevational side view corresponding to FIG. 4, showing the wire tractor in its cable-gripping position.

Geared drive shaft 64 is connected by means of spur gears 70 and 72. Spur gear 70 is affixed to geared drive shaft 64 and provides the primary source of rotation for the wire tractor of the invention. Spur gear 70 engages spur gear 72, which is connected to universally jointed drive shaft 74. In a preferred embodiment, there are two universal joints 76 and 78 on the universally jointed drive shaft 74. Universally joined drive shaft 74 extends through the opening 80 in split top 22 and terminates into drive gear 34. The drive shafts 64 and 74 and mounted within frame 82, which has a horizontal support bar 86. Attached to the horizontal support bar 86 is the support leg 88 of ball joints 75 and 77. The movable arm 90 of the ball joints 75 and 77 is attached to the base 92 of the U-frame 94. The ends 96 of U-frame 94 are mounted of the lower surface 26 of the split top 22. As can be seen in FIGS. 1, 4, and 5, the U-frame 94 is mounted on the back edge of the frame.

To provide locomotion along a cable, there are mounted on horizontal bars 58, by means of vertical support bars 98, a pair of vertically disposed trolley wheels 100 and 102. Also mounted on vertical support bar 98 is carrying handle 104, which contains loop 106 which can be used to lift the device.

To power DC motor 60 is trolley-supported battery 108, which is mounted within battery-holding frame 110, which contains linking bar 112, which connects the battery-holding frame 110 to the carrier 10. Power from the battery 108 is by means of wires 114 and connector 116 to four solenoids, collectively given the numeral 118, which connect to DC motor 60 through wires 114 and also to control switch 120.

The base 20 of carrier 10 at one end is fitted with eyelet 122, to which is attached a rope or a cable 124.

Optional features reside in the use of diagonal braces 126 and 128 and horizontal braces 130 and 132.

To operate the wire tractor apparatus of the invention, it is lifted by means of eyelet 122 until cable 134 is positioned between the pair of looped roller chains 28 and 30, which are in the open position shown in FIG. 4. In this posture, as shown in FIG. 4, drive gear 34 and sprocket gear 38 are in the horizontal position, as is the left half of split top 22.

In FIG. 5, it is shown that by rotating crank handle 54, the threaded end 52 of rotatable horizontal shaft 50 moves the entire left half of split top 22 in an arcuate path so that it engages cable 134. The arcuate path is achieved by movement of universally jointed drive shaft 74 and ball joints 75 and 77. The adjustment of the crank should be such that cable-gripping clamps 40 should frictionally engage cable 134 so that it will provide sufficient pressure to move vertical trolley wheels 100 along cable 134. Too much pressure will cause the unit to bind and be incapable of motion.

An important and valuable feature of the invention is that only one DC motor 60 is used as a power source. By connecting the shafts 64 and 74 through spur gears 70 and 72, there is produced opposed rotation of looped roller chains 28 and 30. To ensure that the speeds of the looped roller chains 28 and 30 are identical, spur gears 70 and 72 have a 1:1 ratio.

After the pair of looped roller chains 28 and 30 is properly engaged against cable 134, switch 120 is activated to energize DC motor 60. This on and off function is achieved by means of two of the solenoids 118, which activate micro switches (not shown). The other two solenoids 118, when activated by switch 120, control the reversibility of DC motor 60. This allows the apparatus to go forward and backward along cable 134.

Another alternate feature of the invention is the inclusion of a smooth rubberized or plastic belt (not shown) that would slip over the outside of the looped roller chains 28 and 30. This embodiment would be used when a lasher is used to lash optical cables. The smooth rubber or plastic on the belt would prevent damage to the optical cable.

Another optional feature of the invention is the use of a radio controller, illustrated by radio receiver 136 mounted within the carrier near its top. This receiver would power a servomechanism, which would operate the on-off and forward and backward functions.

It is understood that in inclement weather, it may be beneficial to enclose the carrier 10 with waterproof fabrics, plastic, wood, or metal panels, to shield the electrical components from water damage. While all of the electrical and mechanical components are located within the carrier 10, save for the looped roller chains 28 and 30 and their gearing, it is possible to locate the drive mechanism on the top of the apparatus.

Having thus described our invention, we claim as follows: We claim:

1. An apparatus for pulling wire and other objects between two vertical supports connected by a cable strung above the ground comprising:

a carrier having four sides, a base, and an adjustable split top having an upper surface and a lower surface;

a pair of driven looped belts horizontally mounted on opposite sides of the split top having outside cable-gripping surfaces;

a pressure-regulating bar positioned within the inside vertical surfaces of the opposed looped belts;

a drive for adjusting the split top so that the opposed looped belts engage the strung cable;

a carrier mounted motorized drive train for turning the opposed looped belts in opposite directions at a constant speed; and a pair of vertical trolley wheels positioned above the opposed looped belts for moving the carrier along the strung cable.

2. An apparatus for pulling wire and other objects between two vertical supports connected by a cable strung above the ground comprising:

a carrier having four sides, a base, and an adjustable split top having an upper surface and a lower surface;

a pair of gear-driven looped roller chains horizontally mounted on opposite sides of the split top having mounted about their outside surfaces cable-gripping clips;

a pressure-regulating bar positioned within the inside surfaces of the opposed looped roller chains;

a drive for adjusting the split top so that the opposed looped roller chains engage the strung cable;

a carrier mounted motorized drive train for turning the opposed looped roller chains in opposite directions at a constant speed; and a pair of vertical trolley wheels positioned above the opposed looped roller chains for moving the carrier along the strung cable.

3. The apparatus of claim 1, where a single motor drives the looped belts.

4. The apparatus of claim 2, where a single motor drives the looped roller chains.

5. The apparatus of claim 2, where the drive train is a gearbox that rotates two spur gear connected shafts that turn adjacent drive gears on either side of the split top in opposite directions.

6. The apparatus of claim 5, where the one of the gear connected shafts is an adjustable shaft.

7. The apparatus of claim 2, where only one side of the split top is adjustable.

8. The apparatus of claim 2, where the adjustable shaft rotates the drive gear on the adjustable side of the split top.

9. The apparatus of claim 8, where the adjustable shaft contains at least one universal joint.

10. The apparatus of claim 2, where the drive for adjusting the split top is a rotatable horizontal carrier mounted shaft having a threaded end engaging a thread receiving mounting located on the bottom of the adjustable side of the split top and a "U" shaped frame mounted to the rear of the bottom of the adjustable side, with the base of the "U" being connected to at least one vertically mounted ball joint.

11. The apparatus of claim 10, where there are two vertically mounted ball joints connected to the base of the "U" and the path of the adjustable side of the split top when moving to engage the cable is arcuate.

12. The apparatus of claim 4, where the single motor is a DC motor actuated with electronic controllers for reversing shaft rotation and providing an on and off function.

13. The apparatus of claim 12, where the DC motor is hard wired.

14. The apparatus of claim 12, where the DC motor is radio controlled.

15. The apparatus of claim 12, where the motor is mounted on the bottom of the carrier.

16. The apparatus of claim 12, where a battery powers the DC motor.

17. The apparatus of claim 16, where the battery is mounted in a housing attached to the carrier having a pair of cable-engaging top mounted vertical trolley wheels.

18. The apparatus of claim 2, where the lower surface of the carrier contains an end-mounted eyelet.

* * * * *